US005824363A

United States Patent [19]

Poole et al.

[11] Patent Number: 5,824,363

[45] Date of Patent: Oct. 20, 1998

[54] WALLPAPER PASTING MACHINE AND METHOD OF MAKING AND USING THE SAME THEREOF

[75] Inventors: Daniel L. Poole, Phoenix; Robert N. Poole, Pinetop, both of Ariz.

[73] Assignee: Blackhawk Metal Products, Inc., Phoenix, Ariz.

[21] Appl. No.: 840,140

[22] Filed: Apr. 11, 1997

Related U.S. Application Data

[60] Provisional application No. 60/015,357 Apr. 12, 1996.

[51] Int. Cl.[6] ..... B05D 1/00

[52] U.S. Cl. ..... 427/207.1; 427/356; 427/428; 118/123; 118/202; 118/252; 118/261; 118/DIG. 17; 156/575

[58] Field of Search ..... 118/202, 252, 118/261, 123, DIG. 17; 156/575; 427/207.1, 356, 428

[56] References Cited

U.S. PATENT DOCUMENTS

| | | | |
|---|---|---|---|
| 90,081 | 5/1869 | Cline . | |
| 128,193 | 6/1872 | Weiss . | |
| 148,129 | 3/1874 | Miner . | |
| 225,860 | 3/1880 | Pattison . | |
| D. 253,512 | 11/1979 | Davenport et al. | D8/14 |
| D. 325,152 | 4/1992 | Poole et al. | D8/14 |
| 387,793 | 8/1888 | McAfee . | |
| 481,251 | 8/1892 | Barton . | |
| 621,595 | 3/1899 | Beal . | |
| 802,292 | 10/1905 | Howell . | |
| 903,672 | 11/1908 | Chatelain . | |
| 998,221 | 7/1911 | Wheeler . | |
| 1,084,964 | 1/1914 | Richardson . | |
| 1,140,112 | 5/1915 | Campbell . | |
| 1,162,247 | 11/1915 | Mobley . | |
| 1,265,127 | 5/1918 | Sleeper . | |
| 1,274,040 | 7/1918 | Hitchcock | 156/575 |
| 1,346,647 | 7/1920 | Germaszewski . | |
| 1,348,290 | 8/1920 | Malacos et al. . | |
| 1,354,148 | 9/1920 | Grigas et al. . | |
| 1,403,395 | 1/1922 | Egleston . | |
| 1,413,443 | 4/1922 | Williams . | |
| 2,151,344 | 3/1939 | Barnard | 91/49 |
| 2,264,501 | 12/1941 | Beach | 91/53 |
| 2,658,639 | 11/1953 | Goldberg | 216/6 |
| 2,662,658 | 12/1953 | Wynn | 216/6 |
| 3,788,270 | 1/1974 | Blair | 118/DIG. 17 |
| 3,960,643 | 6/1976 | Dargitz et al. | 156/390 |
| 4,210,485 | 7/1980 | Lake | 156/577 |

(List continued on next page.)

FOREIGN PATENT DOCUMENTS

| | | | |
|---|---|---|---|
| 2500374 | 8/1982 | France | 118/DIG. 17 |
| 2917 | of 1912 | United Kingdom | 29/110.5 |

*Primary Examiner*—Laura Edwards
*Attorney, Agent, or Firm*—Steven Lin

[57] ABSTRACT

An improved wallpaper pasting machine 10 and method of manufacture and use. The pasting machine 10 has a lid 20 and a trough 30. The lid 20 can completely cover the trough 30 to keep the paste from further drying out. An applying roller 40 for applying paste 90 to wallpaper 100 is placed within the inner compartment 35 of trough 30. A scraper bar 50 is mounted at the rear portion of trough 30, and the scraper bar 50 scrapes excess paste 90 from wallpaper 100. A snap lock 22 located on the lid 20 is used to secure the lid 20 to trough 30. Paper tension ribs 27 and 28 are located in the interior portion of lid 20 for providing tension on wallpaper 100 and for guiding and pressing the wallpaper 100 to the applying roller 40 to apply paste 90 onto the wallpaper 100 as the wallpaper 100 is pulled through the machine 10. A return roller 60 can be adjusted in position and held to one of three sets of holes 24—24, 25—25, and 26—26 that are on the lid. The position adjustment of the return roller 60 allows the thickness of paste 90 that is applied to wallpaper 100 to be varied. The pasting machine 10 can be mounted, attached, or fixed to a surface. Paste 90 is applied to wallpaper 100 by wallpaper 100 being generally placed over the applying roller 40, pulled through pasting machine 10, and pulled around and over return roller 60.

20 Claims, 3 Drawing Sheets

U.S. PATENT DOCUMENTS

| | | | |
|---|---|---|---|
| 4,258,862 | 3/1981 | Thorsheim | 222/56 |
| 4,261,789 | 4/1981 | Spataro | 156/576 |
| 4,314,395 | 2/1982 | Brock | 29/110.5 |
| 4,342,405 | 8/1982 | Croley | 222/105 |
| 4,449,646 | 5/1984 | Bonerb et al. | 222/95 |
| 4,524,714 | 6/1985 | Hohenhovel | 118/123 |
| 4,582,019 | 4/1986 | Barschneider | 118/246 |
| 4,589,207 | 5/1986 | Loth et al. | 30/287 |
| 4,660,502 | 4/1987 | Scott | 118/415 |
| 4,870,920 | 10/1989 | Kageyama et al. | 118/103 |
| 5,330,575 | 7/1994 | Poole et al. | 118/123 |
| 5,421,886 | 6/1995 | Poole et al. | 118/415 |

WALLPAPER PASTING MACHINE AND METHOD OF MAKING AND USING THE SAME THEREOF

This Non-Provisional Application claims the benefit of U.S. Provisional Application No. 60/015,357 filed on Apr. 12, 1996 now abandoned.

BACKGROUND OF THE INVENTION

1. Fields of the Invention

The present invention relates to the field of pasting wallpaper, and, more particularly, relates to an improved wallpaper pasting machine and method of making and using the same.

2. Discussion of Background and Prior Art

Wallpaper is commonly used in decorating interior walls. Wallpaper is placed and applied to the wall by applying wallpaper paste to the back side of the wallpaper and then placing the back side of the wallpaper to the wall and smoothing the wallpaper against the wall surface. Various devices and machines have been developed to apply the paste to the back side of the paper.

For example, U.S. Pat. No. 5,330,575 to Poole et al. ("Poole I") discloses a wallpaper pasting machine that has a trough, an applicator roller, an adjustable flow control bar, a pressure area downstream the applicator roller, and an adjustable scraper bar. The adjustable flow control bar controls the thickness of paste that is applied to the applicator roller. The adjustable scraper bar is able to scrape or remove an amount of paste from the back side of the wallpaper wherein the amount of paste being scraped can be varied by adjusting the scraper bar. Therefore, the operator is able to vary or adjust the flow control bar and the scraper bar of the pasting machine to control the thickness of the paste applied to the wallpaper. However, the wallpaper pasting machine disclosed by Poole I has disadvantages in that adjusting the flow control bar or the scraper bar can be cumbersome or very inconvenient for the operator, and these components may also not be easily adjusted. Furthermore, these components may be relatively expensive to manufacture. Therefore, a wallpaper machine that can easily, conveniently, and cost effectively vary the thickness of paste that is applied to the wallpaper is desired.

A further example is disclosed in U.S. Pat. No. 5,421,886 to Poole et al. ("Poole II"). Poole II discloses a wallpaper paste applying apparatus and method of use. Poole II teaches a paste dispenser that has a paste reservoir and an applicator for containing and applying paste to the wallpaper. The wallpaper apparatus is a package having a container and a base, and the wallpaper apparatus is transformable between a package configuration and an applicator configuration. In the package configuration, the paste dispenser is received within the container and the container is closed by the base. In the applicator configuration, the base extends from the container and carries the paste dispenser. The paste dispenser has an arresting means for limiting the flow of paste from the paste dispenser onto the paper. Poole II, however, has the disadvantage of not allowing an operator of the dispenser to vary or adjust the thickness of the paste applied to the wallpaper.

An example of a wallpaper pasting machine design is disclosed in U.S. Pat. No. D325,152 to Poole et al. ("Poole III"). Poole III discloses and claims a unique ornamental design for a wallpaper pasting machine.

A problem, however, with some of the prior art wallpaper pasting machines is that they are limited to the number and different types of paste that can be used since the thickness and flow of the paste cannot be varied or adjusted in some of these machines. Presently, there is a need for an improved device and machine that applies paste to wallpaper that is economical to manufacture, that is simple and easy to use, and that is relatively inexpensive. Furthermore, there is a need for an improved wallpaper pasting device that can more easily, conveniently, and cost effectively vary the thickness of the paste applied to the wallpaper, that can provide a more airtight compartment for the paste to prevent the paste from drying out, and that can apply different types of paste to the wallpaper.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

Accordingly, it is an object and advantage of the present invention to provide an improved wallpaper pasting machine or device that can more easily and quickly apply paste to wallpaper.

It is one aspect and advantage of the present invention to provide an improved wallpaper pasting machine or device that is economical to manufacture, is simple, easy, clean, and efficient to use, and is able to apply different types of paste to wallpaper that vary in thickness.

It is a further aspect and advantage of the present invention to provide a fixed paste scraper bar that is ribbed and molded into the edge of the trough to provide a rigid scraping surface.

It is a further aspect and advantage of the present invention to provide a return roller having different position settings that change the angle at which the paper contacts or rubs over the scraper bar thereby changing the paste thickness that is applied to the wallpaper.

It is a further aspect and advantage of the present invention to provide paper tension ribs instead of conventional rollers to provide tension on the paper when the paper is placed over the return roller.

It is a further aspect and advantage of the present invention to provide a lid that completely covers the trough to keep the paste from further drying out and optionally provide a foam liner that can be placed on the perimeter of the lid to make a better air-tight fit.

It is a further aspect and advantage of the present invention to provide a lid for the wallpaper pasting machine that has snap locks with release fingers to hold the lid down when the wallpaper is pulled and lifted over the paste application roller of the machine.

It is a further aspect and advantage of the present invention to provide a machine that snaps together and apart in construction without the use of fasteners, screws, or tools and that allows for easy use and clean up.

It is a further aspect and advantage of the present invention to provide feet for supporting the wallpaper machine in an upright position and for taping down, screwing down, or clamping down the machine to a flat surface.

It is another aspect and advantage of the present invention to provide an improved method of applying paste to wallpaper.

It is still another aspect and advantage of the present invention to provide a method of making the improved wallpaper pasting machine.

It is still another aspect and advantage of the present invention to provide a method of using the improved wallpaper pasting machine.

DETAILED DESCRIPTION OF THE PREFERRED EMBODIMENT

The present invention generally discloses an improved wallpaper pasting machine 10 and a method of manufacturing and using the pasting machine 10 wherein the pasting machine is used to apply paste 90 onto wallpaper 100. The wallpaper 100 with the paste 90 can then be applied to a wall surface.

Figure 1:
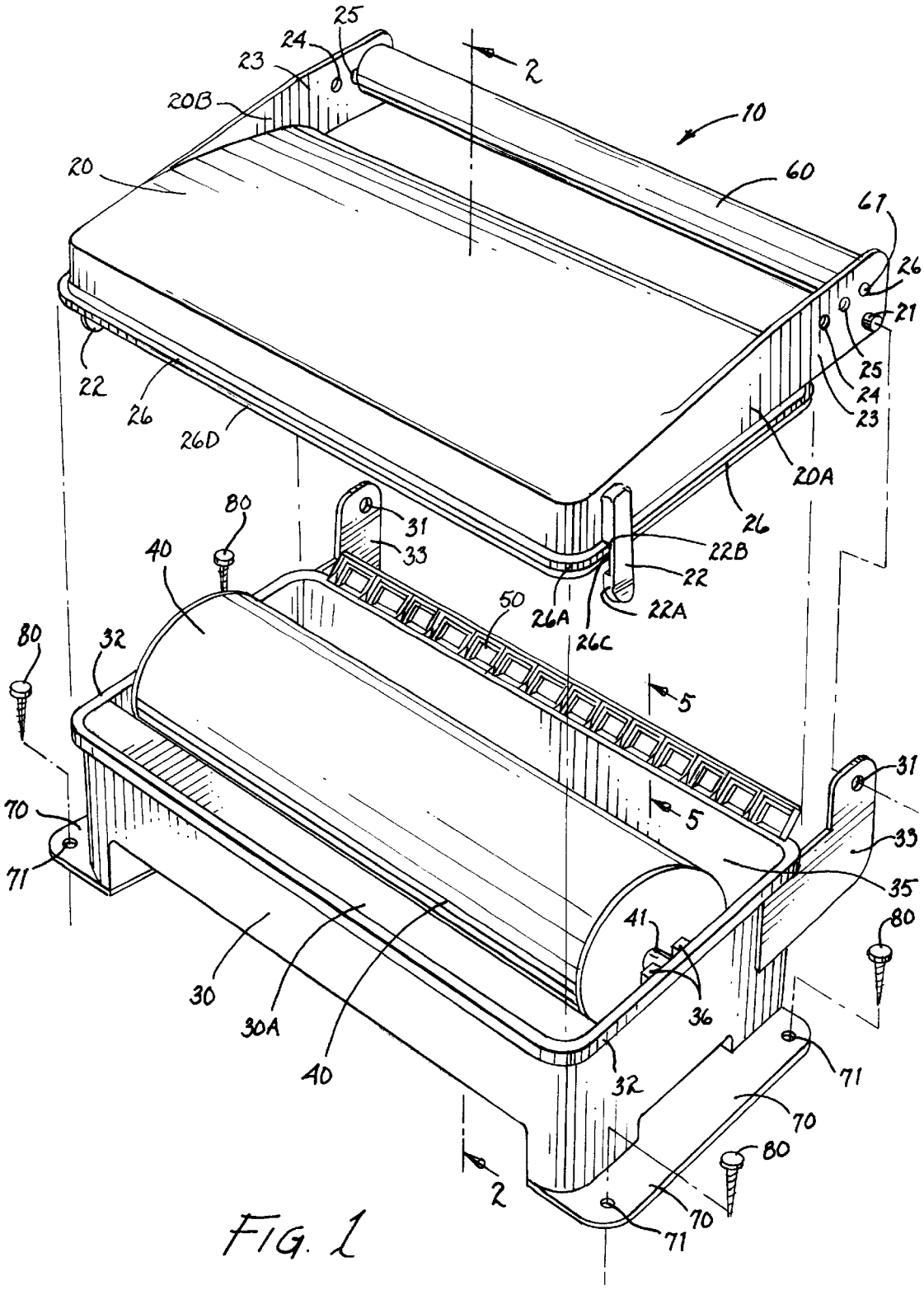
FIG. 1—Perspective view of the preferred embodiment improved wallpaper pasting machine.
Figure 2:
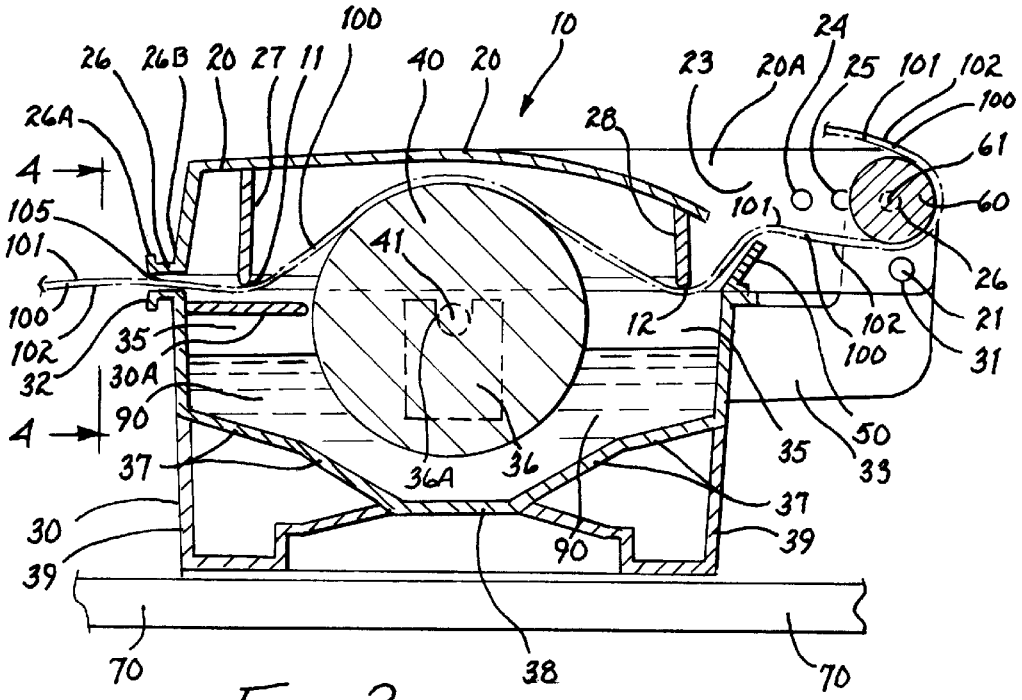
FIG. 2—Cross-sectional side view of the preferred embodiment improved wallpaper pasting machine according to line 2—2 of FIG. 1.

FIG. 1 shows a perspective view of the preferred embodiment wallpaper pasting machine 10, and FIG. 2 shows a side view of the pasting machine 10 according to the line 2—2 of FIG. 1. Improved wallpaper pasting machine 10 has a lid 20 and a trough 30. Lid 20 and trough 30 are generally made of a molded plastic material.

FIG. 1 shows that lid 20 and trough 30 are rectangular in shape. Trough 30 has lid receiver portions 33 that are at the rear sides of the trough 30. Trough 30 also has an inner compartment 35. FIGS. 1 & 2 show that the inner compartment 35 has bottom slanted walls 37 and bottom flat wall 38 at the bottom of the compartment 35. The inner compartment 35 holds the paste or glue 90 in the trough 30.

Figure 5A:
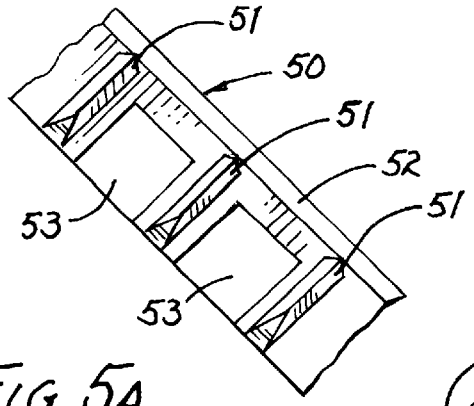
FIG. 5A—Partial perspective view of the scraper bar of the preferred embodiment wall paper pasting machine.

In FIGS. 1 & 2, trough 30 also has trough roller receivers 36 each located at a respective side (i.e. in the middle area) of the inner compartment 35. An applying roller 40 is generally located and held at the inner compartment 35. The bottom slanted walls 37 and bottom wall 38 shape the bottom of the compartment in such a way that the roller 40 is able to rotate within the inner compartment 35. Roller receivers 36 each have a receiving slot 36A that receives and holds a rotating spindle 41 of roller 40. The rotating spindle 41 within the slot 36A allows the roller 40 to rotate within the compartment 35. Roller 40 and spindle 41 can also be made of a plastic material. A scraper bar 50 is mounted to the top rear portion of the trough 30. The scraper bar 50 is mounted to (i.e. molded to) the rear portion at an angle as shown in FIGS. 1, 2, 3, and 5. As shown in FIG. 5A, scraper bar 50 has scraper ribs 51 and scraping edge 52 for scraping the excess paste 90 from the wallpaper 100. Scraper bar 50 also has paste receiving slots 53 for guiding the excess paste 90 down into the trough 30.

Furthermore, a roller scraper 30A is located along the top front edge of the trough 30 as shown in FIG. 1. The roller scraper 30A controls the amount of paste 90 that is applied to roller 40 and maintains the paste 90 evenly spread on roller 40 before the wallpaper 100 comes into contact with the roller 40. Roller scraper 30A also prevents paste 90 from accumulating or building up on roller 40 at each edge of wallpaper 100 as wallpaper 100 is pulled through the pasting machine 10.

Figure 5:
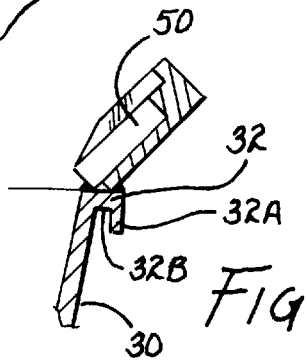
FIG. 5—Partial cross sectional side view of the scraper bar and back of the trough of the preferred embodiment wallpaper pasting machine according to line 5—5 of FIG. 1.

A top trough edge 32 is located along the top perimeter of the trough 30. FIG. 5 shows a partial cross sectional side view of the back of the pasting machine 10 according to the line 5—5 of FIG. 1. The top trough edge 32 is shown to have a downward lip locking portion 32A that is around the entire trough perimeter and that defines a space 32B that is also around the entire trough perimeter.

In FIGS. 1 & 2, a lid engaging portion 33 is located and integrally attached at each rear side of the trough 30. Each lid engaging portion 33 extends outwardly (i.e. perpendicularly) a short distance from the respective rear side of the trough 30. A lid engaging slot 31 is located in each of the lid engaging portions 33, and each slot 31 is able to receive a lid engaging pin 21 of lid 20.

As shown in FIGS. 1 & 2, lid 20 is generally rectangular and has an interior and an exterior portion. A lid roller receiving portion 23 is located and integrally attached at each exterior side of the lid 20, and each lid roller receiving portion 23 extends a small distance from the rear side of the lid 20. A lid engaging pin 21 is located at or near each lid roller receiving portion 23. The lid engaging pins 21 are inserted into and received by the lid engaging slots 31 of the lid engaging portion 33. The pins 21 are able to pivot within the slots 31 which allow the lid 20 to pivot to an open or closed position.

Figure 4:
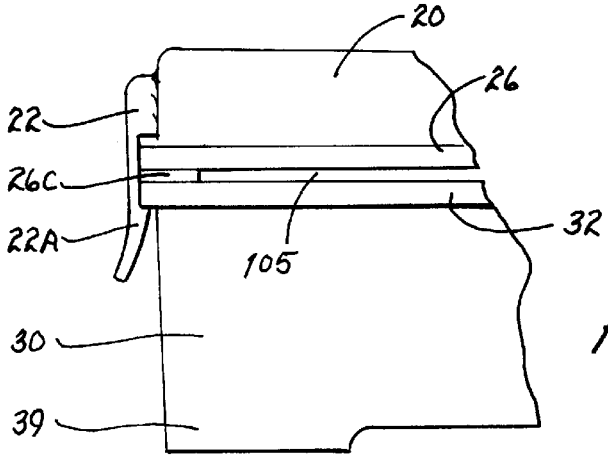
FIG. 4—Partial front view of the preferred embodiment improved wallpaper pasting machine according to line 4—4 of FIG. 2, that shows the lid of the machine having snap locks with release fingers.

In FIGS. 1, 2. 4, and 6, a lid edge 26 is shown to be located along the bottom perimeter of the lid 20. In FIG. 2, the bottom edge 26 has an upward lip portion 26A around the entire bottom perimeter that defines a space 26B that is also around the entire lid perimeter. In FIGS. 1 and 4, a lid foot 26C is located on the bottom of each side of the bottom lid perimeter near the front of the machine 10. When the lid 20 is in the closed position, the lid feet 26C are in contact with the top trough edge 32 so that space 105 exists to allow wallpaper 100 to slide through the pasting machine 10. In the closed lid position, the bottom edge 26 of lid 20 also generally covers the entire top edge of trough 30 to further prevent the paste or glue 90 in trough 30 from drying out. A foam liner 26D as shown in FIG. 1 can also be placed along the entire perimeter of the bottom lid edge 26 to provide an even better airtight fit between the lid 20 and trough 30, which can prevent further drying out of paste 90. When wallpaper 100 is pulled through, foam liner 26D will compress against wallpaper 100 but still allow wallpaper 100 to pull through without letting air in to dry out the paste 90.

Figure 6:
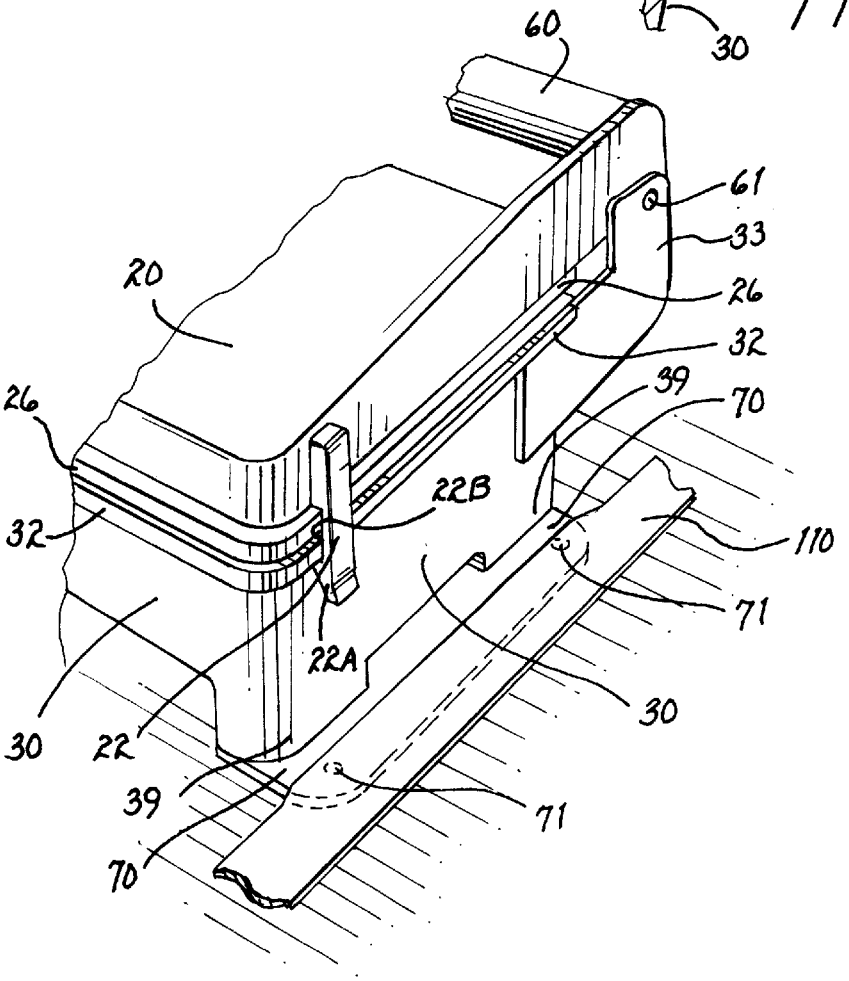
FIG. 6—Partial perspective side view of the preferred embodiment wallpaper pasting machine showing the feet of the machine taped to a flat surface.

In FIGS. 1, 4, and 6, snap locks 22 are located on the side near the front portion of lid 20. Each snap lock 22 has an engaging portion 22A that secures the lid 20 to trough 30. When lid 20 is closed onto trough 30, the engaging portion 22A of snap lock 22 expands slightly outwards and then contracts back so that the groove 22B of snap lock 22 snaps onto and holds the lid edge 26 and the trough edge 32 together and the engaging portion 22A hooks or locks onto the lip locking portion 32A and the space 32B. The lid 20 can be opened or disengaged from the trough 30 by a user slightly bending or expanding the engaging portion 22A outwardly and pivotally lifting the lid 20 from the trough 30.

Figure 3:
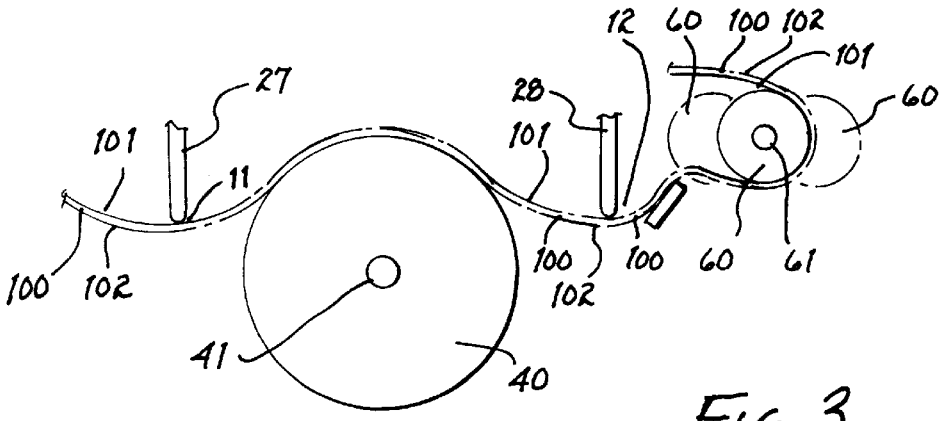
FIG. 3—Side view of the rollers and the ribs of the preferred embodiment improved wallpaper pasting machine that shows a wallpaper portion fed through the rollers and ribs of the machine.

As shown in FIGS. 2 & 3, a longer paper tension rib 27 is located in the interior portion of lid 20 near the front of the lid while a shorter paper tension 28 is also located in the interior portion of lid 20 but near the back of the lid. The paper tension ribs 27 and 28 provide tension on the wallpaper 100, and they guide and press the wallpaper 100 over applying roller 40 so tension of wallpaper 100 turns applying roller 40 to apply paste 90 onto the wallpaper 100.

As shown in FIGS. 1 & 2, corresponding roller receiving holes 24, 25, and 26 are located on each lid roller receiving portion 23. Return roller 60 has a spindle 61, and roller 60 is received and held by one of the corresponding set of holes 24—24, 25—25, or 26—26 that are on the lid roller receiving portion 23 of lid 20. The three sets of holes 24—24, 25—25, and 26—26 are provided on the lid 20 so that the position of the return roller can be adjusted and, as a result, the thickness of the paste 90 that is applied to the wallpaper 100 can be varied (i.e. thick to thin application of paste 90 onto the wallpaper 100 because scraping edge 52 thins paste 90 by scraping it off the wallpaper 100 when the wallpaper 100 contacts over it at different angles).

If the return roller 60 is inserted, received, and held by the pair of holes 24—24, then the scraping surface of the scraper bar 50 will be in an angled contact with the wallpaper 100 to provide a fairly thick (i.e. thick level of paste 90) application of paste 90 onto the wallpaper 100. If the return roller 60 is inserted, received, and held by the pair of holes 25—25, then the scraping surface of the scraper bar 50 will be angled and in greater contact with the wallpaper 100 than when the roller 60 is in holes 24—24 and the paste 90 that will be applied to the wallpaper 100 will be moderately thick (i.e. medium level of thickness of paste 90). If the return roller 60 is inserted, received, and held by the pair of holes 26—26, then the scraping surface of the scraper bar 50 will be further angled and in even greater contact with the wallpaper 100 than when the roller 60 is in the holes 25—25 and the paste 90 that will be applied to the wall will be fairly thin (i.e. thin level of paste 90).

In FIGS. 1, 2, and 6, trough 30 has four feet 39 wherein each foot 39 is at the bottom of the trough 30, and a mounting surface 70 is integrally attached to two of the side feet 39 (i.e. pasting machine 10 in FIG. 1 shows two mounting surfaces 70 wherein each mounting surface 70 is attached to two feet 39). Each mounting surface 70 has holes 71 located near each corner of the trough 30. As shown in FIG. 1, screws or nails 80 can be mountingly inserted through the holes 71 and the screws can attach the mounting surface 70 and the trough 30 to a surface (i.e. a fixed surface). Alternatively, as shown in FIG. 6, each mounting surface 70 can be attached and taped or clamped to a surface (i.e. a fixed surface) by using tape 110 or clamps.

As stated earlier, lid 20 is pivotally attached to trough 30 respectively at lid engaging pins 21 and lid engaging slots 31. The lid 20 is pivoted into its open position (i.e. lid 20 is not covering trough 30). The return roller 60 is inserted and secured into the desired set of holes (i.e. either hole, set 24—24, 25—25, or 26—26) that will provide the desired amount (i.e. thickness or thinness) of paste 90 that is to be applied to the wallpaper 100. Referring to FIGS. 2 and 3, the back side 102 of wallpaper 100 is generally placed over the trough 30, the applying roller 40, and the scraper bar 50. The wallpaper 100 is fed to the rear side of the machine 10 so that the front side 101 of the wallpaper 100 is fed and contacting underneath the return roller 60 and a slack of wallpaper 100 is fed past the return roller 60.

Lid 20 is then pivoted into its closed position by securing lid 20 to trough 30 and snap locking it into place (i.e. snap locks 22 engage and hold together lid edge 26 and trough edge 32). In FIGS. 2 and 3, after lid 20 is placed into the closed position, longer tension rib 27 and shorter tension rib 28 places tension on the wallpaper 100 and further secures and presses the back side 102 of wallpaper 100 onto the applying roller 40. Wallpaper 100 is guided through slot 105 between the lid edge 26 and trough edge 32, underneath the longer tension rib 27 and through an opening 11, over the applying roller 40, underneath the shorter tension rib 28 and through an opening 12, over the scraper bar 50, underneath the return roller 60, and around and over the roller 60.

The wallpaper 100 is pulled through the pasting machine 10 by pulling the wallpaper 100 that is at or past the return roller 60, and the lid 20 is held downwardly to the trough 30 by the snap locks 22 when the wallpaper 100 is being pulled from the machine 10. Furthermore, the pulling force of the wallpaper 100 that causes lifting force on lid 20 reduces the tension of the wallpaper 100 on the applying roller 40. The wallpaper 100 is pulled underneath the return roller 60 and over the top of roller 60 wherein the front side 101 of wallpaper 100 contacts and rotatingly engages the return roller 60. The wallpaper 100 is pulled through the pasting machine 10, and the surface of roller 40 is rotated so that it continues to be in contact and applied with the paste 90 in trough 30 and paste 90 continues to be applied to the back side 102 of wallpaper 100 as the wallpaper 100 is pulled through and rotates the applying roller 40. Roller scraper 30A maintains paste 90 evenly spread on the roller 40 before wallpaper 100 comes into contact with roller 40 and also prevents the build up of excess paste 90 on roller 40 at each edge of the wallpaper 100 as the wallpaper 100 is being pulled through the pasting machine 10. The backside 102 of wallpaper 100 is pulled over the scraper bar 50, and excess paste 90 is scraped from the wallpaper 100 by scraping ribs 51 and scraping edge 52 and allowed to flow down through paste receiving slot 53 and back into the trough 30. The wallpaper 100 is pulled through the pasting machine 10 a certain amount to provide a desired length of pasted wallpaper 100.

The advantages provided by the pasting machine 10 is that it has a scraper bar 50 with scraping ribs 51 that is mounted to or molded into the trough edge 32 of trough 30 which makes it strong and ridged even if it is made of plastic. Furthermore, pasting machine 10 provides a way to adjust the position of the return roller 60 to vary the thickness and thinness of the paste 90 being applied to the wallpaper 100 (i.e. scraper bar 50 thins paste 90 by scraping it off the wallpaper 100 when the wallpaper 100 contacts over the scraper bar 50 at different angles). Also, pasting machine 10 uses simple paper tension ribs 27 and 28 that are fixed to the lid 20 for applying tension to and guiding the wallpaper 100 instead of using more complicated rollers as taught in prior art patents.

Additionally, lid 20 completely covers the trough 30 to further prevent the paste 90 from drying out. The snap lock construction of pasting machine 10 provides a way to secure the lid 20 to the trough 30 when the wallpaper 100 is being pulled from the machine 10. The snap lock construction holds the lid and paper tension ribs 27 and 28 down to provide the proper tension on the wallpaper 100 and to applying roller 40, which gives enough tension to properly turn the applying roller 40.

Pasting machine 10 furthermore has a snap together and snap apart construction that uses no screws, fasteners, or tools which provide for easy use and clean up and further provides a cost effective way of manufacturing a pasting machine 10. Pasting machine 10 also has mounting surfaces 70 that allow the pasting machine 10 to be easily taped, screwed, or clamped down to a surface (i.e. fixed surface).

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable other skilled in the art to best utilize the invention in various embodiments and with various modifications as are suited to the particular use contemplated.

What is claimed is:

1. An improved wallpaper pasting machine for applying paste or glue to a wallpaper wherein the machine has an input end for inputting the wallpaper into the machine and has an output end for outputting the wallpaper from the machine comprising:

a trough having an inner compartment for holding paste or glue, a trough roller mounted in the trough so that the trough roller is able to rotate within the inner compartment to pick up the paste or glue in the trough and contact a side of the wallpaper to which the paste or glue is applied, a lid that guides and presses the wallpaper to the trough roller wherein the lid is hingedly attached to the trough and is pivotable between an open position and a closed position and wherein the wallpaper is able to be pulled through the machine between the lid and the trough, a scraper bar mounted at an angle to the trough near the output end wherein the scraper bar scrapes and guides excess paste or glue back into the trough, and a return roller mounted to the lid that is adjustable in position relative to the scraper bar wherein the return roller is able to rotate and contactingly guide the wallpaper so that amounts of paste or glue applied to the wallpaper can be controllably varied.

2. The improved wallpaper pasting machine according to claim 1 wherein the lid further comprises:

a return roller receiving portion having at least three sets of holes wherein the return roller is positioned and removably mounted to one of the at least three sets of holes and wherein the sets of the at least three sets of holes located closer to the scraper bar provide the return roller with a position in which the wallpaper is able to have a less angled contact with the scraper bar to respectively provide a thicker application of paste or glue to the wallpaper and wherein the sets of the at least three sets of holes located further away from the scraper bar provide the return roller with a position in which the wallpaper is able to have a more angled contact with the scraper bar to respectively provide a thinner application of paste or glue to the wallpaper.

3. The improved wallpaper pasting machine according to claim 1 wherein the trough further comprises:

an inner compartment having a bottom that has a flat central portion and at least two upwardly and angularly sloping portions from the flat central portion so that the trough roller is able to rotate within the inner compartment.

4. The improved wallpaper pasting machine according to claim 1:

wherein each end of the trough roller further comprises a rotating spindle, and wherein the trough further comprises trough roller receivers in which each of the roller receivers have a receiving slot and the roller receivers are located on inner side walls of the trough to receive each of the rotating spindles of the trough roller so that the trough roller is allowed to rotate within the trough.

5. The improved wallpaper pasting machine according to claim 1 wherein:

the scraper bar has scraper ribs, a scraping edge for scraping excess paste or glue from the wallpaper, and paste receiving slots for guiding the excess paste or glue back into the trough.

6. The improved wallpaper pasting machine according to claim 1 further comprises:

a roller scraper mounted near the input end for controlling amounts of paste or glue to be applied to the trough roller so that the paste or glue is evenly spread on the trough roller and excess paste or glue is prevented from accumulating on the trough roller.

7. The improved wallpaper pasting machine according to claim 1 wherein:

the trough further comprises a trough edge along a top perimeter of the trough wherein the trough edge has a downward lip locking portion along an entire perimeter of the trough defining a space therein and the lid further comprises a lip edge located along a bottom perimeter of the lid wherein the lip edge has an upward lip portion along an entire perimeter of the lid defining a space therein, and the lip edge contacts the trough edge when the lid is in the closed position.

8. The improved wallpaper pasting machine according to claim 7 further comprising:

at least one snap lock attached to the lid for securing the lid to the trough wherein each of the at least one snap lock has an engaging groove that hooks to the lip locking portion of the trough to hold the lip edge and the trough edge together.

9. The improved wallpaper pasting machine according to claim 1 further comprises:

at least two paper tension ribs attached to the lid for providing tension to guide and press the wallpaper over the trough roller to apply the paste or glue onto the wallpaper wherein one of the at least two ribs is located near the input end and another of the at least two ribs is located near the output end.

10. The improved wallpaper pasting machine according to claim 1 wherein:

each end of the return roller further comprises a rotating spindle that is mountable to the lid.

11. The improved wallpaper pasting machine according to claim 1 further comprises:

feet located at a bottom side of the trough for allowing the trough to be mounted to a surface.

12. The improved wallpaper pasting machine according to claim 1 wherein the lid further comprises:

lid feet attached to a bottom side of the lid for defining a space between the lid and the trough through which the wallpaper is able to be pulled.

13. The improved wallpaper pasting machine according to claim 1 further comprises:

a foam liner placed along an entire bottom perimeter of the lid to provide a further airtight fit between the lid and the trough to prevent further drying of the paste or glue in the trough.

14. A method of making an improved wallpaper pasting machine for applying paste or glue to a wallpaper wherein the machine has an input end for inputting the wallpaper into the machine and has an output end for outputting the wallpaper from the machine comprising the steps of:

providing a trough having an inner compartment for holding paste or glue, mounting a trough roller in the trough so that the trough roller is able to rotate within the inner compartment to pick up the paste or glue in the trough and contact a side of the wallpaper to which the paste or glue is applied, hingedly attaching a lid to the trough wherein the lid guides and presses the wallpaper to the trough roller and the lid is pivotable between an open position and a closed position and wherein the wallpaper is able to be pulled through the machine between the lid and the trough, mounting a scraper bar near the output end at an angle to the trough that scrapes and guides excess paste or glue back into the trough, and mounting a return roller to the lid that is adjustable in position relative to the scraper bar wherein the return roller is able to rotate and contactingly guide the wallpaper so that amounts of paste or glue applied to the wallpaper can be controllably varied.

15. The method of making an improved wallpaper pasting machine according to claim 14 wherein the hingedly attaching a lid step further comprises the step of:

providing a return roller receiving portion having at least three sets of holes as part of the lid wherein the return roller is positioned and removably mounted to one of the at least three sets of holes and wherein the sets of the at least three sets of holes located closer to the scraper bar provide the return roller with a position in which the wallpaper is able to have a less angled contact with the scraper bar to respectively provide a thicker application of paste or glue to the wallpaper and wherein the sets of the at least three sets of holes located further away from the scraper bar provide the return roller with a position in which the wallpaper is able to have a more angled contact with the scraper bar to respectively provide a thinner application of paste or glue to the wallpaper.

16. The method of making an improved wallpaper pasting machine according to claim 14 further comprising the step of:

mounting a roller scraper near the input end for controlling amounts of paste or glue to be applied to the trough roller so that the paste or glue is evenly spread on the trough roller and excess paste or glue is prevented from accumulating on the trough roller.

17. The method of making an improved wallpaper pasting machine according to claim 14 further comprising the step of:

providing at least one snap lock attached to the lid for securing the lid to the trough.

18. The method of making an improved wallpaper pasting machine according to claim 14 further comprising the step of:

attaching at least two paper tension ribs to the lid for providing tension to guide and press the wallpaper over the trough roller to apply the paste or glue onto the wallpaper wherein one of the at least two ribs is located near the input end and another of the at least two ribs is located near the output end.

19. A method of using an improved wallpaper pasting machine for applying paste or glue to a wallpaper wherein the machine comprises a trough having an inner compartment for holding paste or glue, a trough roller that is able to rotate within the inner compartment of the trough to pick up the paste or glue in the trough and contact a side of the wallpaper to which the paste or glue is applied, a lid that guides and presses the wallpaper to the trough roller wherein the lid is hingedly attached to the trough and is pivotable between an open position and a closed position and wherein the wallpaper is able to be pulled through the machine between the lid and the trough, a scraper bar mounted near the output end at an angle to the trough that scrapes and guides excess paste or glue back into the trough, and a return roller mounted to the lid that is adjustable in position relative to the scraper bar wherein the return roller is able to rotate and contactingly guide the wallpaper so that amounts of paste or glue applied to the wallpaper can be controllably varied, comprising the steps of:

placing the paste or glue into the trough, putting the lid into the open position, laying the wallpaper onto the trough roller and over the scraper bar, placing the lid into the closed position so that at least a portion of the lid guides and presses the wallpaper to the trough roller, adjusting the position of the return roller so that the desired amount of the paste or glue is able to be applied onto the wallpaper, directing the wallpaper around the return roller, and pulling the wallpaper from the input end to the output end of the machine so that the wallpaper contacts the trough roller and the paste or glue is applied onto the wallpaper and so that the wallpaper contacts the scraper bar at a desired angle so that excess paste or glue is scraped from the wallpaper.

20. The method of using an improved wallpaper pasting machine according to claim 19 wherein the pulling step further comprises the step of:

pulling the wallpaper to cause lifting force on the lid so that tension of the wallpaper on the trough roller is reduced.

* * * * *